US006875024B2

(12) United States Patent
Nagano

(10) Patent No.: US 6,875,024 B2
(45) Date of Patent: Apr. 5, 2005

(54) COAXIAL CONNECTOR FOR RECEIVING A CONNECTOR PLUG

(75) Inventor: Atsushi Nagano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/338,721

(22) Filed: Jan. 9, 2003

(65) Prior Publication Data

US 2003/0181073 A1 Sep. 25, 2003

(30) Foreign Application Priority Data

Mar. 22, 2002 (JP) ..... 2002-080664

(51) Int. Cl.[7] ..... H01R 9/09
(52) U.S. Cl. ..... 439/63; 439/578; 439/581
(58) Field of Search ..... 439/63, 581, 578, 439/584, 620

(56) References Cited

U.S. PATENT DOCUMENTS 5,769,652 A * 6/1998 Wider ..... 439/248
5,971,770 A * 10/1999 Richmond ..... 439/63
6,071,144 A * 6/2000 Tang ..... 439/426
6,299,479 B1 * 10/2001 Tang ..... 439/578
6,409,519 B1 * 6/2002 Bacon ..... 439/63

FOREIGN PATENT DOCUMENTS

JP 3074150 U 10/2000

* cited by examiner

*Primary Examiner*—Hien Vu
(74) *Attorney, Agent, or Firm*—Birch, Stewart, Kolasch & Birch, LLP

(57) ABSTRACT

A coaxial connector includes a central contact for elastically holding a central terminal of a connector plug, a first holding member receiving and holding the central contact therein, a second holding member linked to the first holding member, and a shell holding the linked first holding member and second holding member therein. The first holding member has a slide channel portion on its outer surface, and the second holding member has a protruding portion that can be inserted into the slide channel portion on its rear side. A disengagement-prevention structure is formed with a fit projective portion provided on the slide channel portion and a fit hole portion provided on the protruding portion.

8 Claims, 8 Drawing Sheets

COAXIAL CONNECTOR FOR RECEIVING A CONNECTOR PLUG

BACKGROUND OF THE INVENTION

1. Field of the Invention

The present invention relates to a coaxial connector used as an input/output terminal of communication equipment, and to a converter including the same for receiving satellite broadcasting.

2. Description of the Background Art

A coaxial cable is commonly used to connect communication equipment. Thus, communication equipment is provided with a coaxial connector as an input/output terminal. In a converter for receiving satellite broadcasting, for example, a coaxial connector is provided on a chassis as an output terminal to send an electric signal to a connector plug of a coaxial cable.

FIG. 10 is a cross-sectional view of a structure of a conventional coaxial connector, which is taken along an axial direction. FIG. 11 is a cross-sectional view taken along the line XI-XI shown in FIG. 10. To simplify the descriptions, a tip side of the coaxial connector, that is, the side into which the coaxial cable is inserted is referred to as a front side, and a bottom side is referred to as a rear side hereafter.

As shown in FIG. 10, a coaxial connector 1E is formed with a central contact 10, a first holding member 20, a second holding member 30, and a shell 40. Central contact 10 includes a terminal reception portion 11, a spaced portion 12, and a trunk portion 13. Central contact 10 is formed with a conductive material, and elastically holds a central terminal of a connector plug of a coaxial cable with terminal reception portion 11 located on its front end. The elastic force to hold the central terminal of the coaxial cable is provided by spaced portion 12 continuously formed in the rear of terminal reception portion 11. That is, terminal reception portion 11 is elastically energized by spacing terminal reception edges of central contact 10, as shown in the drawing. Trunk portion 13 is continuously formed in the rear of spaced portion 12, and has its rear end connected to a pattern of a circuit substrate 60 with solder 70.

First holding member 20 is formed with a cylindrical insulator including a square hole 21 in its center. Trunk portion 13 of central contact 10 is inserted and held in square hole 21. A link projection 22 is provided on a front end of first holding member 20. Link projection 22 is a site to hold spaced portion 12 of central contact 10 and to link first holding member 20 to second holding member 30. In addition, first holding member 20 has an abutting surface 25 in a plane intersecting with an axial direction. Herein, a portion of first holding member 20 which holds spaced portion 12 of central contact 10, that is, link projection 22 is referred to as a first region 20A, and a portion which holds trunk portion 13 is referred to as a second region 20B. That is, second region 20B is located in the rear of first region 20A.

Second holding member 30 is formed with a cylindrical insulator including on its front end a terminal insertion opening 31, into which the central terminal of the connector plug of the coaxial cable is inserted. Second holding member 30 is attached to link projection 22 of first holding member 20 so as to cover terminal reception portion 11 and spaced portion 12 of central contact 10. This attachment is performed only by fitting first holding member 20 into second holding member 30. In this step, second holding member 30 is positioned by abutting on abutting surface 25 of first holding member 20.

Shell 40 is formed with a substantially cylindrical conductive material which is formed to extrude forward from a prescribed site of a chassis 50, and receives and outer terminal of the connector plug of the coaxial cable. A thread 41 is provided to a prescribed position of a peripheral surface of shell 40 to maintain the connection with the connector plug. Chassis 50 is generally made of aluminum alloy, zinc alloy or the like, and shell 40 is formed by a through hole for die-casting. Therefore, a cylindrical hole of shell 40 is formed to be slightly larger in the front portion and smaller in the rear portion due to a draft angle of the casting. First and second holding members 20 and 30 linked to each other are press-fitted into the cylindrical hole inside shell 40, whereby shell 40 holds holding members 20 and 30.

In coaxial connector 1E having the above-described structure, however, because first and second holding members 20 and 30 press-fitted into shell 40 are linked only with link projection 22 provided on the front end of first holding member 20 as shown in FIGS. 10 and 11, the holding force thereof is insufficient. In addition, because shell 40 holds first and second holding members 20 and 30 only with the press-fit of an inner surface of shell 40 and outer surfaces of first and second holding members 20 and 30, the holding force thereof may be insufficient. Therefore, second and first holding members 30 and 20 may be disengaged while the connector plug of the coaxial cable is repeatedly inserted into and drawn from coaxial connector 1E.

Japanese Utility Model Registration No. 3074150 describes a coaxial connector which prevents the disengagement of the first and second holding members. FIG. 12 is a cross-sectional view of the coaxial connector taken along an axial direction, and FIG. 13 is a cross-sectional view taken along the line XIII—XIII shown in FIG. 12. As shown in FIGS. 12 and 13, in a coaxial connector 1F, a fit projective portion 24*f* is provided on link projection 22, which is the first region of first holding member 20, and a fit hole portion 34*f*, into which fit projective portion 24*f* is fitted, is provided in a corresponding inner surface portion of second holding member 30 in the linkage site of first and second holding members 20 and 30 in coaxial connector 1E having the above-described structure. That is, a disengagement-prevention structure is provided on a portion corresponding to first region 20A of first holding member 20. In other words, the disengagement-prevention structure is located in the front of abutting surface 25 of first holding member 20.

Therefore, the linkage between first and second holding members 20 and 30 can be kept strong by fitting fit projective portion 24*f* into fit hole portion 34*f* during the linkage of first and second holding members 20 and 30. As a result, disengagement of holding members 20 and 30 is prevented.

The holding force, however, may not be kept sufficiently even in coaxial connector 1F having the disengagement-prevention structure described above. When an ambient temperature is low, for example, as first and second holding members 20 and 30 formed with insulating members have higher degrees of shrinkage than that of shell 40 formed with a conductive member, they may be disengaged due to insertion and drawing of the connector plug.

In addition, highly complex manufacturing steps are needed to provide fit projective portion 24*f* on link projection 22 of first holding member 20 as in the above-mentioned structure. That is, first holding member 20 is generally produced with injection molding of plastic or the like, and a sliding core is needed for the mold in this situation, which makes the mold structure complex. Therefore, the manufacturing cost increases.

SUMMARY OF THE INVENTION

An object of the present invention is to provide a coaxial connector which can easily and inexpensively be manufactured and which can prevent disengagement of first and second holding members even when a connector plug is repeatedly inserted and drawn, and to provide a converter including the coaxial connector for receiving satellite broadcasting.

A coaxial connector according to one aspect of the present invention, into which a connector plug of a coaxial cable is inserted from a front side, includes a central contact, a first holding member, a second holding member, and a shell. The central contact is formed with a conductive member, and includes a terminal reception portion elastically holding a central terminal of the connector plug, a spaced portion continuously formed in the rear of the terminal reception portion and elastically energizing the terminal reception portion, and a trunk portion continuously formed in the rear of the spaced portion. The first holding member is formed with an insulating a member, and the central contact is inserted and held therein. The second holding member is linked to the first holding member so as to cover the terminal reception portion. The shell is formed with a conductive member and holds the linked first and second holding members therein. The first holding member includes a first region holding the spaced portion of the central contact and a second region holding the trunk portion. A disengagement-prevention structure to secure linkage of the first and second holding members is provided on a site corresponding to the second region of the first holding member in a linkage site of the first and second holding members.

By providing the disengagement-prevention structure on the site corresponding to the second region of the first holding member in the linkage site of the first and second holding members as described above, a fitting force between the first and second holding members becomes stronger than that in the conventional coaxial connector. This is because, as the shell is formed by a through hole for die-casting, it has a smaller inner diameter in a rear portion. That is, the fitting force becomes stronger by providing the disengagement-prevention structure on the second region in the rear side, rather than on the first region. With this, the holding members become harder to be disengaged as compared with the conventional coaxial connector, even when an ambient temperature is low.

In the coaxial connector according to the aforementioned aspect of the present invention, it is preferable that a slide channel portion is provided on an outer surface of the second region of the first holding member, and a protruding portion which can be inserted into the slide channel portion is provided to protrude in the rear of the second holding member. The disengagement-prevention structure is preferably formed with a fit projective portion provided on the slide channel portion and a fit hole portion into which the fit projective portion is fitted. By providing the slide channel portion on the first holding member and providing the protruding portion which can be inserted into the slide channel portion on the second holding member as described above, the first and second holding members can easily be assembled. Furthermore, a disengagement-prevention structure can easily be provided on a site corresponding to the second region of the first holding member by providing the disengagement-prevention structure including the fit projective portion and the fit hole portion on the slide channel portion and the protruding portion.

In the coaxial connector according to the aforementioned aspect of the present invention, it is preferable that the first holding member is molded with a soft plastic material, and the fit projective portion is formed by forcedly-drawn molding. By forming the first holding member with the soft plastic material, the first holding member can forcedly be drawn at injection molding thereof. Therefore, the sliding core is unnecessary, and the mold structure becomes simple.

In the coaxial connector according to the aforementioned aspect of the present invention, it is preferable that a portion of the first holding member provided with the fit projective portion has the largest diameter in the first holding member in the linkage site of the first and second holding members. The sliding core becomes unnecessary when the fit projective portion provided on the first holding member has the largest diameter in the first holding member and a mating surface (part surface) of the mold for injection molding is set on this portion. Therefore, inexpensive manufacturing is possible even if the first holding member is made of a hard plastic material.

In the coaxial connector according to the aforementioned aspect of the present invention, it is preferable that a slide channel portion is provided on an outer surface of the second region of the first holding member, and a protruding portion which can be inserted into the slide channel portion is provided to protrude in the rear of the second holding member. The disengagement-prevention structure is preferably formed with a fit concave portion provided on the slide channel portion and a fit convex portion provided on the second holding member and fitted into the fit concave portion. By providing the slide channel portion on the first holding member and providing the protruding portion which can be inserted into the slide channel portion on the second holding member as described above, the first and second holding members can easily be assembled. Furthermore, a disengagement-prevention structure can easily be provided on a site corresponding to the second region of the first holding member by providing the disengagement-prevention structure including the fit concave portion and the fit convex portion on the slide channel portion and the protruding portion.

In the coaxial connector according to the aforementioned aspect of the present invention, it is preferable that the second holding member is molded with a soft plastic material, for example, and the fit convex portion is formed by forcedly-drawn molding. By forming the second holding member with the soft plastic material, the second holding member can forcedly be drawn at injection molding thereof. Therefore, the sliding core is unnecessary, and the mold structure becomes simple.

A coaxial connector according to another aspect of the present invention, into which a connector plug of a coaxial cable is inserted from a front side, includes a central contact, a first holding member, a second holding member, and a shell. The central contact is formed with a conductive member, and includes a terminal reception portion elastically holding a central terminal of the connector plug. The first holding member is formed with an insulating member, and the central contact is inserted and held therein. The second holding member is linked to the first holding member so as to cover the terminal reception portion. The shell is formed with a conductive member and holds the linked first and second holding members therein. The first holding member has an abutting surface to abut on the second holding member in a plane intersecting with an insertion direction of the connector plug. A disengagement-prevention structure to secure linkage of first and second holding members is provided on a site in the rear of the abutting surface in a linkage site of the first and second holding members.

By providing the disengagement-prevention structure on the site in the rear of the abutting surface in the linkage site of the first and second holding members as described above, a fitting force between the first and second holding members becomes stronger than that in the conventional coaxial connector. This is because, as the shell is formed by a through hole of die-casting, it has a smaller inner diameter in a rear portion. That is, the fitting force becomes stronger by providing the disengagement-prevention structure in the rear of the abutting surface, rather than on the front side. With this, the holding members become harder to be disengaged as compared with the conventional coaxial connector, even when an ambient temperature is low.

A coaxial connector according to a further aspect of the present invention, into which a connector plug of a coaxial cable is inserted from a front side, includes a central contact, a first holding member, a second holding member, and a shell. The central contact is formed with a conductive member, and includes a terminal reception portion elastically holding a central terminal of the connector plug. The first holding member is formed with an insulating member, and the central contact is inserted and held therein. The second holding member is linked to the first holding member so as to cover the terminal reception portion. The shell is formed with a conductive member and holds the linked first and second holding members therein. A disengagement-prevention structure is provided on a contact site of the second holding member and the shell.

By providing the disengagement-prevention structure on a contact site of the second holding member and the shell as described above, disengagement of the second holding member can be prevented. As the first holding member is located in the rear of the second holding member in this structure, disengagement of the first holding member is also prevented. Therefore, occurrence of the disengagement becomes harder as compared with the conventional coaxial connector in which the holding members are simply press-fitted into the shell.

In the coaxial connector according to the further aspect of the present invention, it is preferable that the disengagement-prevention structure is formed with a fit pawl portion provided on the second holding member and a fit step portion provided on the shell, into which the fit pawl portion is fitted. By forming the disengagement-prevention structure with the fit step portion provided on the shell and the fit pawl portion provided on the second holding member as described above, the disengagement-prevention structure is easily implemented and can easily be assembled.

In the coaxial connector according to the further aspect of the present invention, it is preferable that the shell has a fit concave and convex portion on its inner surface, and the disengagement-prevention structure is formed by press-fitting the second holding member into the shell. By forming the concave and convex portion on the inner surface of the shell, a holding force of the shell to hold the second holding member after the press-fit of the second holding member increases, and disengagement of the second and first holding members is prevented. In addition, the assembly thereof can be performed very easily.

In the coaxial connector according to the further aspect of the present invention, it is preferable that the above-described fit concave and convex portion is an internal thread provided to have a spiral shape. By forming the fit concave and convex portion on the inner surface of the shell into the internal thread shape, the holding force can easily be enhanced.

A converter for receiving satellite broadcasting according to the present invention includes any of the above-described coaxial connectors. Thus, the present invention can be applied to a converter for receiving satellite broadcasting, and is especially effective in a converter for receiving satellite broadcasting which is mounted outdoors.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
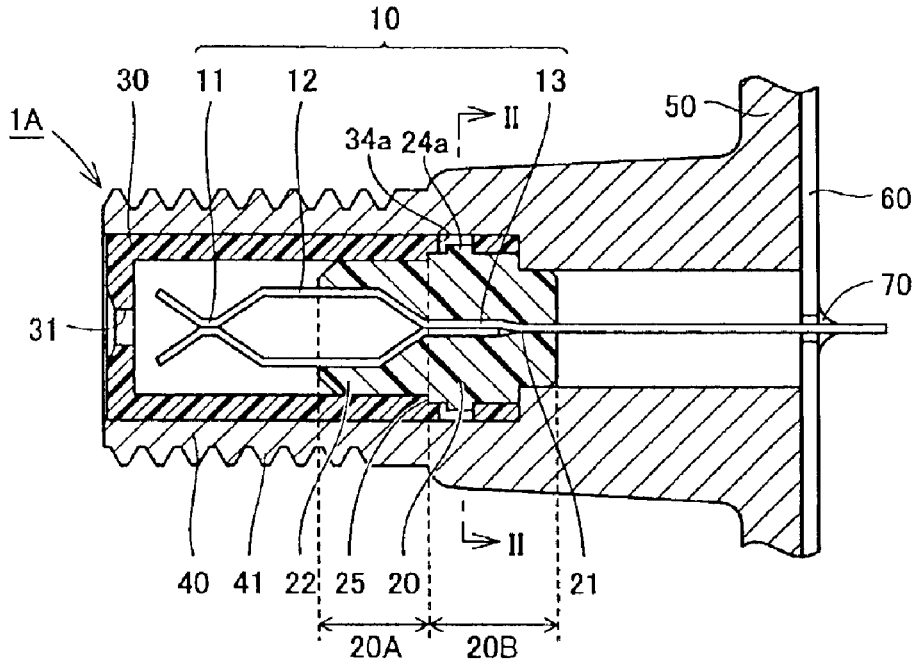
FIG. 1 is a cross-sectional view of a coaxial connector according to a first embodiment of the present invention, which is taken along an axial direction.

Embodiments of the present invention will now be described with reference to the drawings.

(First Embodiment)

A structure of a coaxial connector according to a first embodiment of the present invention will be described referring to FIGS. 1 to 3. Herein, the same portions as those in conventional coaxial connectors 1E and 1F described above are indicated by the same characters in the drawings, and the descriptions thereof will not be repeated.

Figure 2:
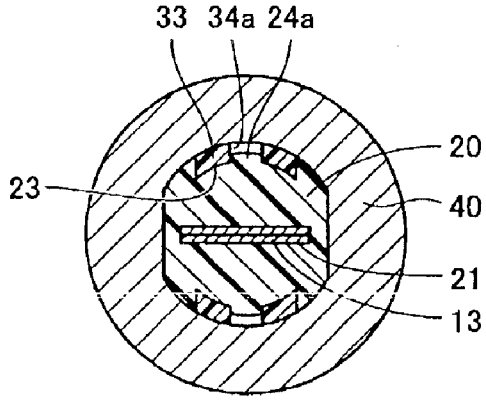
FIG. 2 is a cross-sectional view of the coaxial connector in the first embodiment of the present invention, which is taken along the line II—II shown in FIG. 1.

As shown in FIG. 1, similar to conventional coaxial connectors 1E and 1F described above, a coaxial connector 1A in this embodiment is formed with central contact 10, first holding member 20, second holding member 30, and shell 40. First holding member 20 has first region 20A holding spaced portion 12 of central contact 10 and second region 20B holding trunk portion 13.

Figure 3:
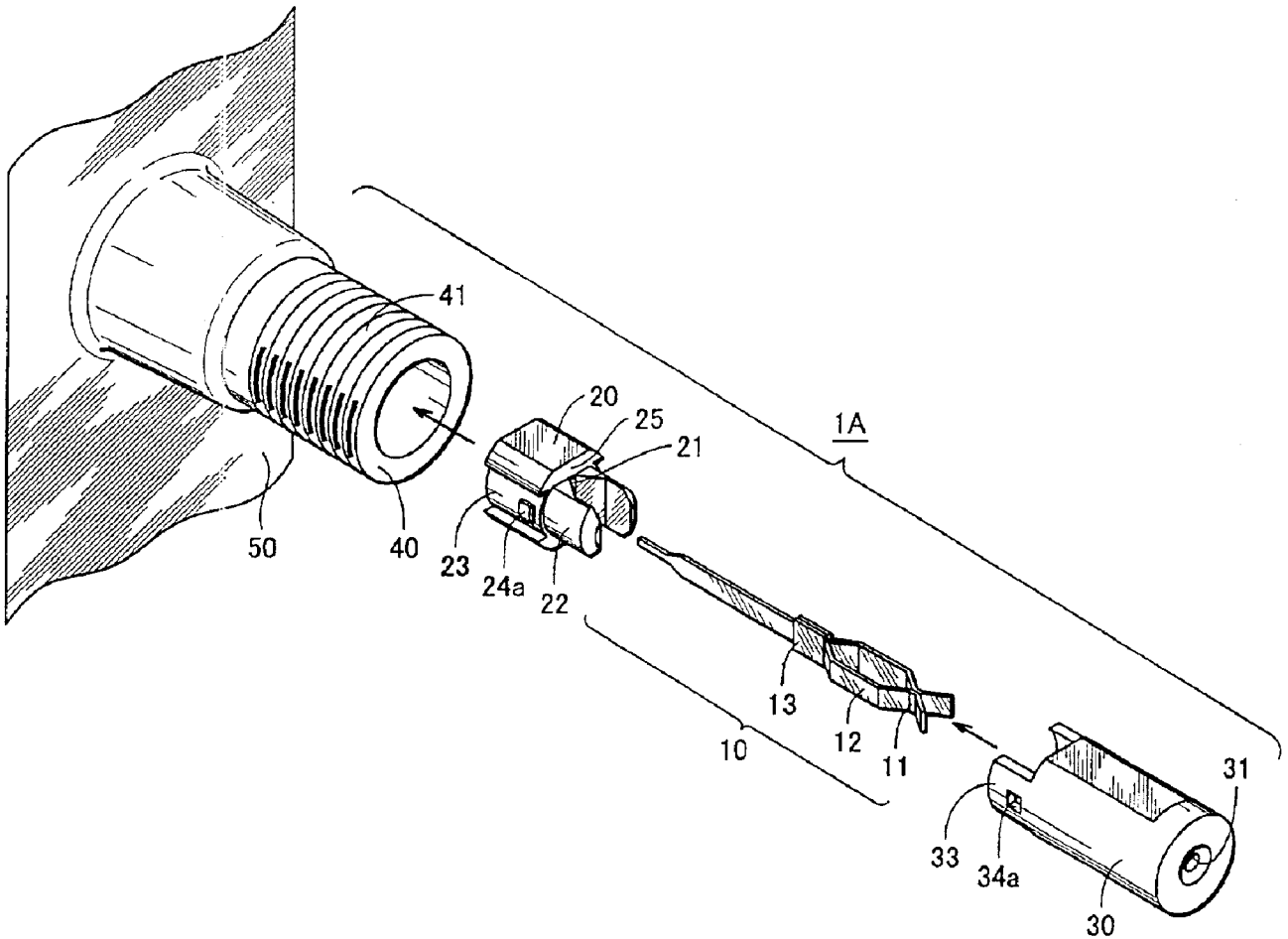
FIG. 3 is an exploded perspective view for describing an assembly structure of the coaxial connector in the first embodiment of the present invention.

As shown in FIG. 3, similar to conventional coaxial connectors 1E and 1F, coaxial connector 1A in this embodiment is assembled by inserting central contact 10 into square hole 21 of the first holding member, linking second holding member 30 to link projection 22 of first holding member 20 so as to cover terminal reception portion 11 and spaced portion 12 of central contact 10, and press-fitting the linked first and second holding members 20 and 30 into the cylindrical hole of shell 40.

In coaxial connector 1A in this embodiment, a disengagement-prevention structure to secure linkage of first and second holding members 20 and 30 is provided on a site corresponding to second region 20B of first holding member 20, which is different from that in conventional coaxial connector 1F described above. In other words, the disengagement-prevention structure is located in the rear of abutting surface 25 of first holding member 20. More specifically, as shown in FIGS. 1 and 3, a slide channel portion 23 is provided on an outer surface of second region 20A of first holding member 20, and a protruding portion 33 which can be inserted into slide channel portion 23 is provided on a rear portion of second holding member 30. In addition, a fit projective portion 24*a* is provided on slide channel portion 23, and a fit hole portion 34*a* is provided in protruding portion 33.

In coaxial connector 1A in this embodiment, protruding portion 33 of second holding member 30 is guided and inserted into slide channel portion 23 of first holding member 20 during linkage of first and second holding members 20 and 30. In this step, first and second holding members 20 and 30 are fitted and the linkage is secured by fit projective portion 24*a* fitting into fit hole portion 34*a*. Herein, the first holding member is positioned by second holding member 30 abutting on abutting surface 25 of first holding member 20. With this, first and second holding members 20 and 30 can easily and securely be linked.

After the linked first and second holding members 20 and 30 are press-fitted into the cylindrical hole within shell 40, coaxial connector 1A in this embodiment has stronger fitting force than that of conventional coaxial connector 1F also having a disengagement-prevention structure. This is because, as shell 40 is formed by a through hole for die-casting, it has a smaller inner diameter in the rear portion. That is, the fitting force becomes stronger by providing the disengagement-prevention structure on second region 20B in the rear side, rather than on first region 20A. With this, holding members 20 and 30 are hardly disengaged even when, in particular, an ambient temperature is low.

In coaxial connector 1A in this embodiment, first holding member 20 may be formed using a soft plastic material. With this, first holding member 20 can forcedly be drawn at injection molding thereof, and thus the mold structure becomes simple. Examples of the soft plastic material include polyethylene and polypropylene.

In addition, in coaxial connector 1A in this embodiment, when fit projective portion 24*a* provided on first holding member 20 is designed to have the largest diameter in first holding member 20 in the linkage site of first and second holding members 20 and 30, and a part surface of a mold for injection molding is set on this portion, the molding can be performed with a mold which does not need a sliding core. That is, as the forcedly-drawn molding becomes unnecessary with such a structure, a hard plastic material can also be used, and the fitting force can further be stronger.

(Second embodiment)

A structure of a coaxial connector according to a second embodiment of the present invention will be described referring to FIGS. 4 and 5. Herein, the same portions as those in the first embodiment described above are indicated by the same characters in the drawings, and the descriptions thereof will not be repeated.

Figure 4:
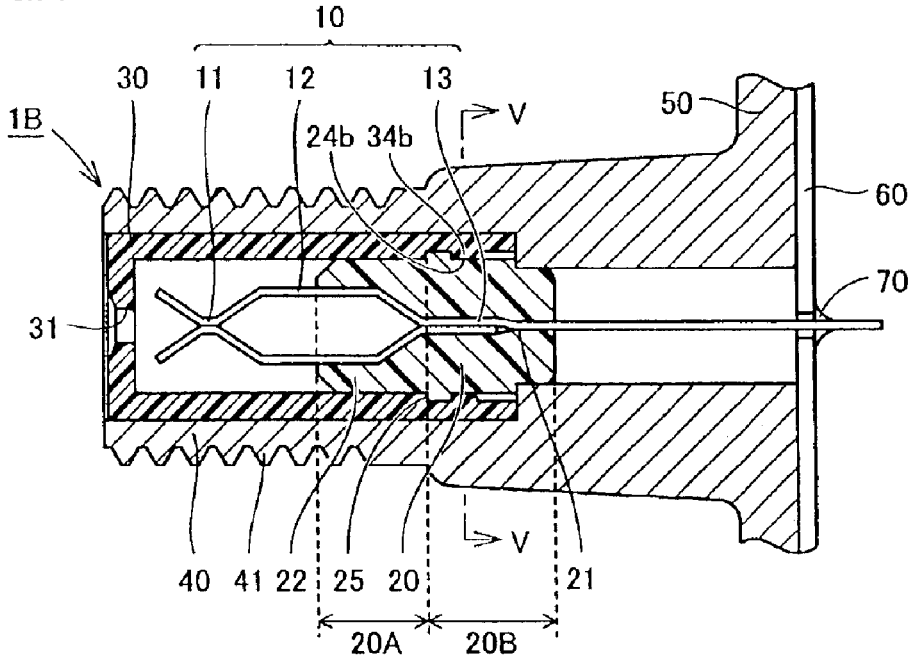
FIG. 4 is a cross-sectional view of a coaxial connector according to a second embodiment of the present invention, which is taken along an axial direction.
Figure 5:
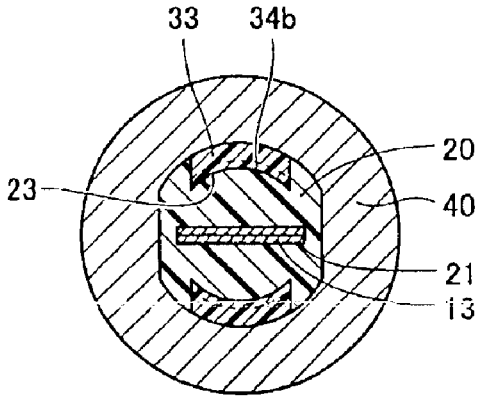
FIG. 5 is a cross-sectional view of the coaxial connector in the second embodiment of the present invention, which is taken along the line V—V shown in FIG. 4.

As shown in FIGS. 4 and 5, a coaxial connector 1B in this embodiment differs from coaxial connector 1A in the first embodiment only in a structure of a disengagement-prevention structure securing the linkage of first and second holding members 20 and 30. In coaxial connector 1B in this embodiment, a fit concave portion 24*b* is provided on slide channel portion 23 of first holding member 20, and a fit convex portion 34*b* is provided on protruding portion 33 of second holding member 30.

In coaxial connector 1B in this embodiment, protruding portion 33 of second holding member 30 is guided and inserted into slide channel portion 23 of first holding member 20 during linkage of first and second holding members 20 and 30. In this step, first and second holding members 20 and 30 are fitted and the linkage is secured by a fit of fit concave portion 24*b* and fit convex portion 34*b*. Herein, the first holding member is positioned by second holding member 30 abutting on abutting surface 25 of first holding member 20. With this, first and second holding members 20 and 30 can easily and securely be linked. In addition, the fitting force after the press-fit also becomes stronger in this embodiment, because the disengagement-prevention structure is located on the second region of first holding member 20.

In coaxial connector 1B in this embodiment, second holding member 30 may be formed using a soft plastic material. With this, second holding member 30 can forcedly be drawn at injection molding thereof, and thus the mold structure becomes simple. Examples of the soft plastic material include polyethylene and polypropylene.

(Third Embodiment)

A structure of a coaxial connector according to a third embodiment of the present invention will be described referring to FIGS. 6 and 7. Herein, the same portions as those in the first and second embodiments described above are indicated by the same characters in the drawings, and the descriptions thereof will not be repeated.

Figure 6:
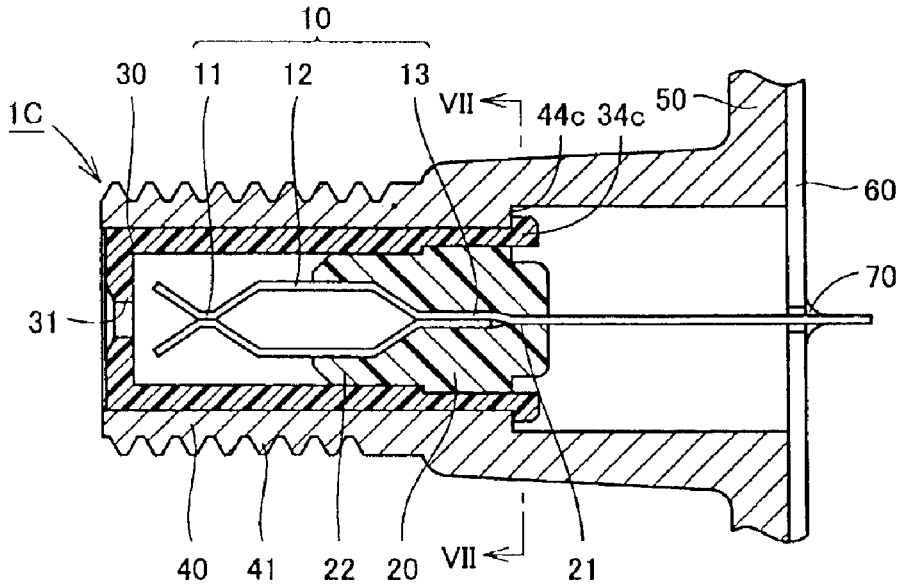
FIG. 6 is a cross-sectional view of a coaxial connector according to a third embodiment of the present invention, which is taken along an axial direction.
Figure 7:
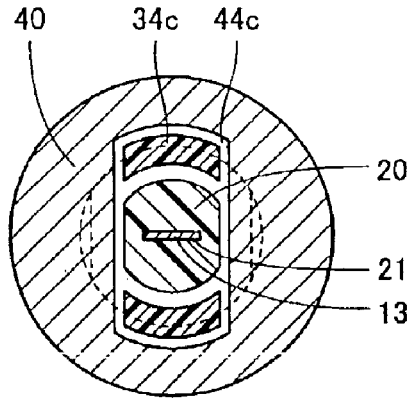
FIG. 7 is a cross-sectional view of the coaxial connector in the third embodiment of the present invention, which is taken along the line VII—VII shown in FIG. 6.

As shown in FIGS. 6 and 7, a coaxial connector 1C in this embodiment is not provided with a disengagement-prevention structure to secure the linkage of first and second holding members 20 and 30. In place of the disengagement-prevention structure, a fit pawl portion 34*c* is provided on the rear end of second holding member 30, and a fit step portion 44*c* is provided on a prescribed position of an inner surface of shell 40.

By press-fitting first and second holding members 20 and 30 into the cylindrical hole within shell 40 after linking the members, fit pawl portion 34*c* and fit step portion 44*c* are fitted, and thus second holding member 30 and shell 40 are strongly fitted. Herein, holding members 20 and 30 can easily be press-fitted into shell 40 if fit pawl portion 34*c* is tapered.

With the above-described structure, second holding member 30 is not disengaged from shell 40 even when the connector plug of the coaxial cable is repeatedly inserted and drawn. First holding member 20 is also not disengaged because it is located in the rear of second holding member 30.

(Fourth Embodiment)

A structure of a coaxial connector according to a fourth embodiment of the present invention will be described referring to FIG. 8. Herein, the same portions as those in the first to third embodiments described above are indicated by the same characters in the drawing, and the descriptions thereof will not be repeated.

Figure 8:
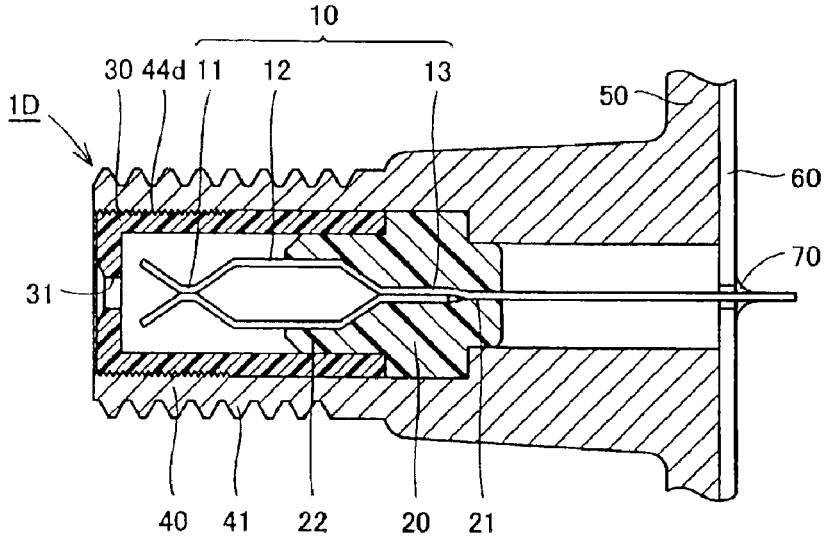
FIG. 8 is a cross-sectional view of a coaxial connector according to a fourth embodiment of the present invention, which is taken along an axial direction.

As shown in FIG. 8, similar to the third embodiment described above, a coaxial connector 1D in this embodiment is not provided with a disengagement-prevention structure to secure the linkage of first and second holding members 20 and 30. In place of the disengagement-prevention structure, a fine fit concave and convex portion 44*d* is provided on a prescribed position of an inner surface of shell 40. Fit concave and convex portion 44*d* is preferably provided on a front portion of shell 40. An example of such a concave and convex shape includes an internal thread shape.

First and second holding members 20 and 30 are press-fitted into the cylindrical hole within shell 40 after the members are linked. In this step, second holding member 30 is strongly fitted into shell 40 by fit concave and convex portion 44*d* of shell 40 engaged with the outer surface of second holding member 30 disengaged from shell 40 even when the connector plug of the coaxial cable is repeatedly inserted and drawn. First holding member 20 is also not disengaged because it is located in the rear of second holding member 30.

(Fifth Embodiment)

Figure 9:
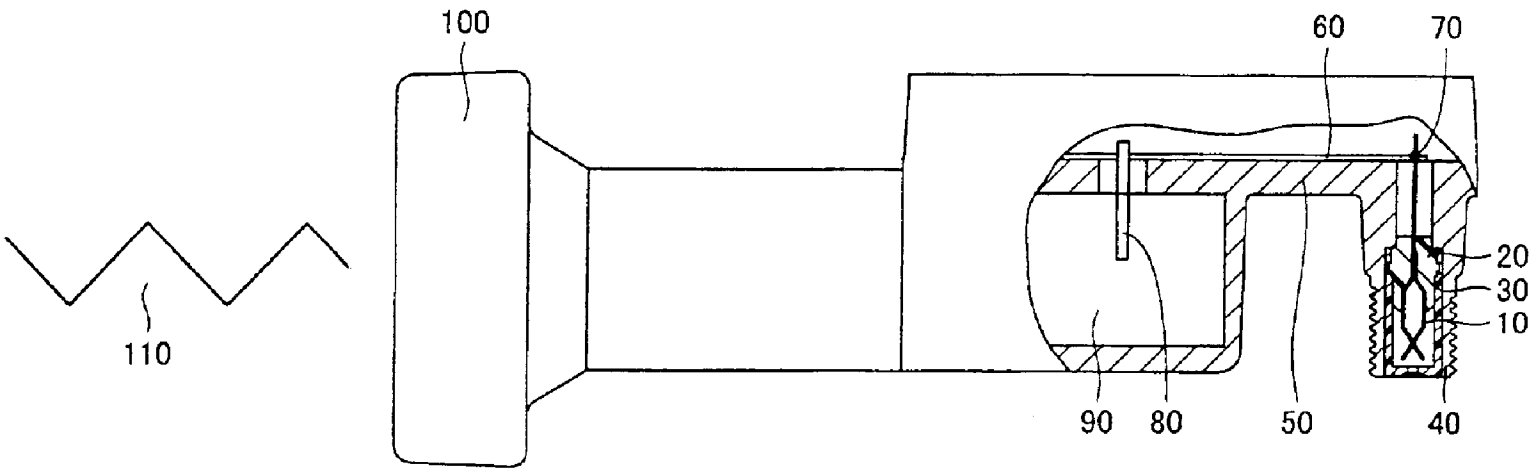
FIG. 9 is a partially cross-sectioned view of a converter for receiving satellite broadcasting according to a fifth embodiment of the present invention.
Figure 10:
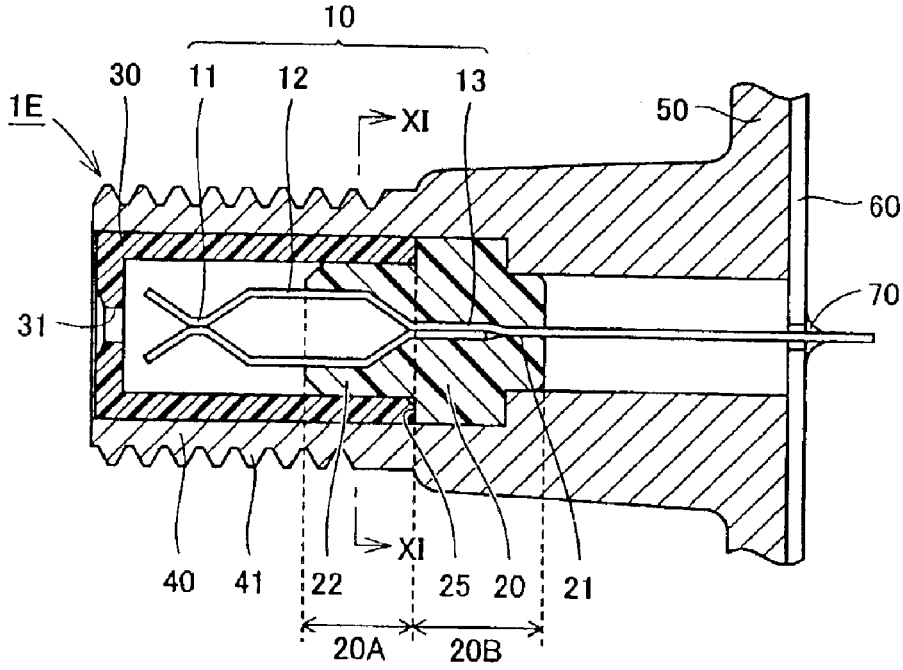
FIG.10 PRIOR ART
FIG. 10 is a cross-sectional view of an example of a conventional coaxial connector, which is taken along an axial direction.
Figure 11:
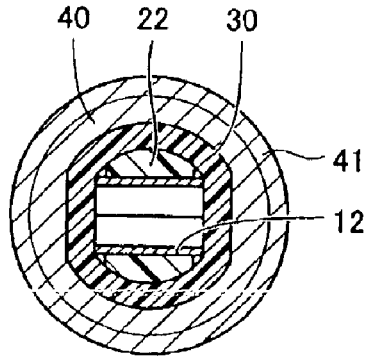
FIG.11 PRIOR ART
FIG. 11 is a cross-sectional view taken along the line XI—XI shown in FIG. 10.
Figure 12:
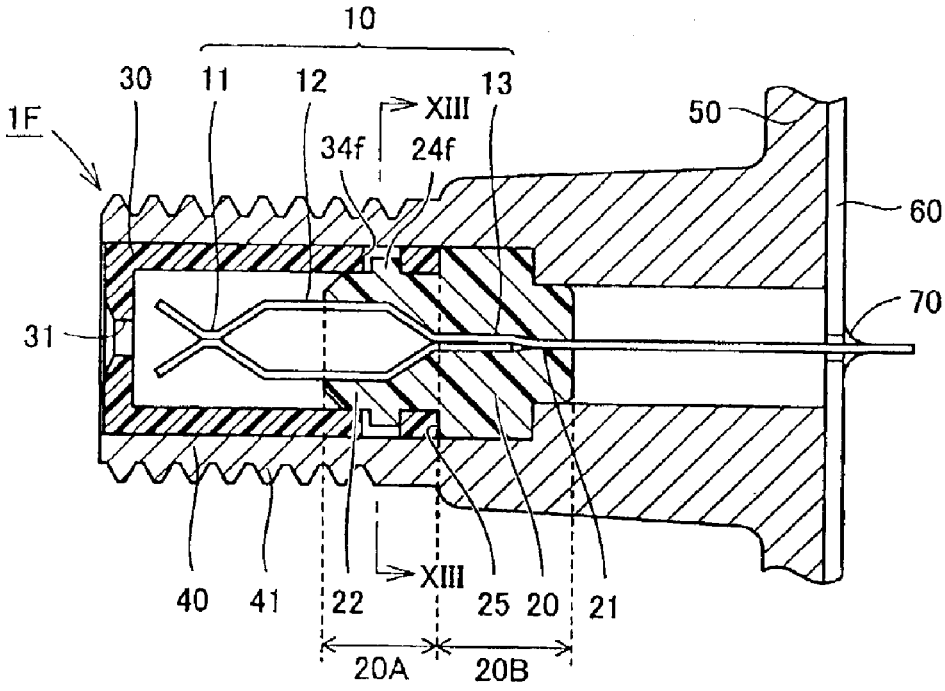
FIG.12 PRIOR ART
FIG. 12 is a cross-sectional view of another example of a conventional coaxial connector, which is taken along an axial direction.
Figure 13:
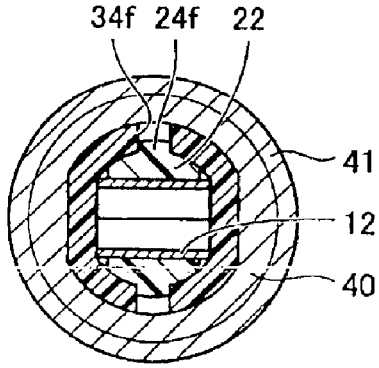
FIG.13 PRIOR ART
FIG. 13 is a cross-sectional view taken along the line XIII—XIII shown in FIG. 12.

A structure of a converter for receiving satellite broadcasting according to a fifth embodiment of the present invention will-be described with reference to FIG. 9. A signal 110 from a broadcasting satellite, which is collected with a parabolic antenna (not shown), is received by a horn 100 and passes through a waveguide 90 to be received at an antenna 80, and is sent to a circuit substrate 60. The signal amplified with circuit substrate 60 is converted to have an intermediate frequency, and the result is sent to a coaxial connector 1 to be output. Chassis 50 of the converter for receiving satellite broadcasting is made of aluminum alloy, zinc alloy or the like, and shell 40 is formed by a through hole for die-casting. Therefore, it is desirable to adopt coaxial connectors 1A–1D according to the present invention as described above.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coaxial connector to receive a connector plug of a coaxial cable in a front side thereof, comprising:

a central contact formed of a conductive material and including a terminal reception portion for elastically holding a central terminal of said connector plug, a spaced portion formed at the rear of said terminal reception portion, and a trunk portion continuously formed in the rear of said spaced portion;

a first holding member formed of an insulating material and receiving and holding said central contact therein;

a second holding member linked to said first holding member so as to cover said terminal reception portion; and a shell formed of a conductive material and holding said first holding member and said second holding member, wherein said first holding member includes a first region holding said spaced portion of said central contact and a second region holding said trunk portion, and a disengagement-prevention structure to secure linkage of said first holding member and said second holding member is provided at a location corresponding to said second region of said first holding member in a linkage location of said first holding member and said second holding member, a slide channel portion is provided on an outer surface of said second region of said first holding member, and a protruding portion that can be inserted into said slide channel portion is provided protruding from the rear of said second holding member, and said disengagement-prevention structure is formed with a fit projective portion provided on said slide channel portion and a fit hole portion provided on said protruding portion and receiving said fit projective portion.

2. The coaxial connector according to claim 1, wherein said first holding member is molded with a soft plastic material, and said fit projective portion is formed by forcedly-drawn molding.

3. The coaxial connector according to claim 1, wherein a portion of said first holding member provided with said fit projective portion has the largest diameter in said first holding member in a linkage site of said first holding member and said second holding member.

4. A coaxial connector to receive a connector plug of a coaxial cable in a front side thereof, comprising:

a central contact formed of a conductive material and including a terminal reception portion for elastically holding a central terminal of said connector plug, a spaced portion formed at the rear of said terminal reception portion, and a trunk portion continuously formed in the rear of said spaced portion;

a first holding member formed of an insulating material and receiving and holding said central contact therein;

a second holding member linked to said first holding member so as to cover said terminal reception portion; and a shell formed of a conductive material and holding said first holding member and said second holding member, therein: wherein said first holding member includes a first region holding said spaced portion of said central contact and a second region holding said trunk portion, and a disengagement-prevention structure to secure linkage of said first holding member and said second holding member is provided at a location corresponding to said second region of said first holding member in a linkage location of said first holding member and said second holding member, wherein a slide channel portion is provided on an outer surface of said second region of said first holding member, and a protruding portion that can be inserted into said slide channel portion is provided to protrude from the rear of said second holding member, and said disengagement-prevention structure is formed with a fit concave portion provided on said slide channel portion and a fit convex portion provided on said second holding member and fitted into said fit concave portion.

5. The coaxial connector according to claim 4, wherein said second holding member is molded with a soft plastic material, and said fit convex portion is formed by forcedly-drawn molding.

6. A coaxial connector to receive a connector plug of a coaxial cable in a front side thereof, comprising:

a central contact formed of a conductive material and including a terminal reception portion for elastically holding a central terminal of said connector plug;

a first holding member formed of an insulating material and receiving and holding said central contact therein;

a second holding member linked to said first holding member so as to cover said terminal reception portion; and a shell formed of a conductive material and holding said first holding member and said second holding member, said second holding member is linked to said first holding member therein;

a disengagement-prevention structure is provided on a contact location of said second holding member and said shell, wherein:

said disengagement-prevention structure is formed with a tapered fit pawl portion provided on said second holding member and a fit step portion provided on said shell to receive said fit portion wherein said pawl portion extends solely in a single direction.

7. The coaxial connector according to claim 6, wherein said shell which has an inner surface has a fit concave and convex portion on its inner surface, and said disengagement-prevention structure is formed by press-fitting said second holding member into said shell.

8. The coaxial connector according to claim 7, wherein said fit concave and convex portion is an internal thread with a spiral shape.

* * * * *